United States Patent [19]

Krier et al.

[11] 4,138,756

[45] Feb. 13, 1979

[54] SURFACE MAINTENANCE MACHINE DRIVE AND BRUSH

[75] Inventors: Keith N. Krier, Tonka Bay; Richard A. Mason, Buffalo, both of Minn.

[73] Assignee: Tennant Company, Minneapolis, Minn.

[21] Appl. No.: 838,565

[22] Filed: Oct. 3, 1977

[51] Int. Cl.[2] ..... E01H 1/04

[52] U.S. Cl. ..... 15/83; 15/340

[58] Field of Search ..... 15/82–87, 15/340

[56] References Cited

U.S. PATENT DOCUMENTS

| | | | |
|---|---|---|---|
| 3,084,367 | 4/1963 | Radinse | 15/181 |
| 3,165,775 | 1/1965 | Lutz | 15/340 |
| 3,222,706 | 12/1965 | Kaar et al. | 15/83 X |
| 3,691,579 | 9/1972 | Kasper | 15/83 |

*Primary Examiner*—Edward L. Roberts

[57] ABSTRACT

A mobile sweeping machine having separate hydraulic motors for driving a main brush, a propulsion wheel, and a curb brush and a suction blower; a constant speed power source that through a mechanical drive connection drive two variable speed displacement pumps and a fixed displacement pump; one of the variable displacement pumps being fluidly connected to the propulsion wheel motor; the other variable displacement pump being fluidly connected to the main brush motor; and the fixed displacement pump being fluidly connected to a valve for operating the cylinder for varying the downward pressure on the main brush, and to a valve for selectively applying fluid to the cylinder for operating the sweeper hopper, and supplying fluid to drive the curb brush and suction blower motors. A manual control is provided for operating the main brush hydraulic motor to discontinue the rotation of the main brush, to drive the main brush at a low brush speed, and to drive the main brush at a high brush speed. Brush tuft mounting annular flanges are tack welded to a brush tube at spaced locations around the inner peripheries of the flanges which are axially spaced from one another on the brush tube.

11 Claims, 7 Drawing Figures

SURFACE MAINTENANCE MACHINE DRIVE AND BRUSH

BACKGROUND OF THE INVENTION

A self-propelled power driven surface maintenance machine, such as a sweeping machine, have a hydraulically operated debris receptacle, propulsion wheel and a curb brush.

In the prior art, for example, U.S. Pat. Nos. 3,165,775 and 3,691,579, there are disclosed power sweepers having hydraulically operated curb brush, propulsion wheel and receptacle. In order to provide a hydraulic system that permits driving the main brush at different speeds, as well as providing other advantages over prior art machines, this invention has been made.

SUMMARY OF THE INVENTION

A self-propelled surface maintenance machine having a curb brush, a receptacle for debris, lift arms for elevating the receptacle, a piston-cylinder combination for operating the lift arms, a first hydraulic motor for driving the propulsion wheel, a second hydraulic motor for driving the curb brush, a third hydraulic motor for driving the main brush, and a plurality of pumps or pump sections drive by the main drive motor. One pump section is of a variable displacement type for driving the first hydraulic motor, a second pump section is of a variable displacement type for driving the main brush, and the third pump section through control valves selectively apply the fluid under pressure to accessories such as the curb brush motor, hopper lift cylinder, vacuum blower motor, and etc.

One of the objects of this invention is to provide new and novel means for driving the main brush of a surface maintenance machine at different selected rotary brush speeds, i.e. for variable speed brush drive. Another object of this invention is to provide new and novel mounting of brush tuft mounting flanges on a brush core.

Figure 1:
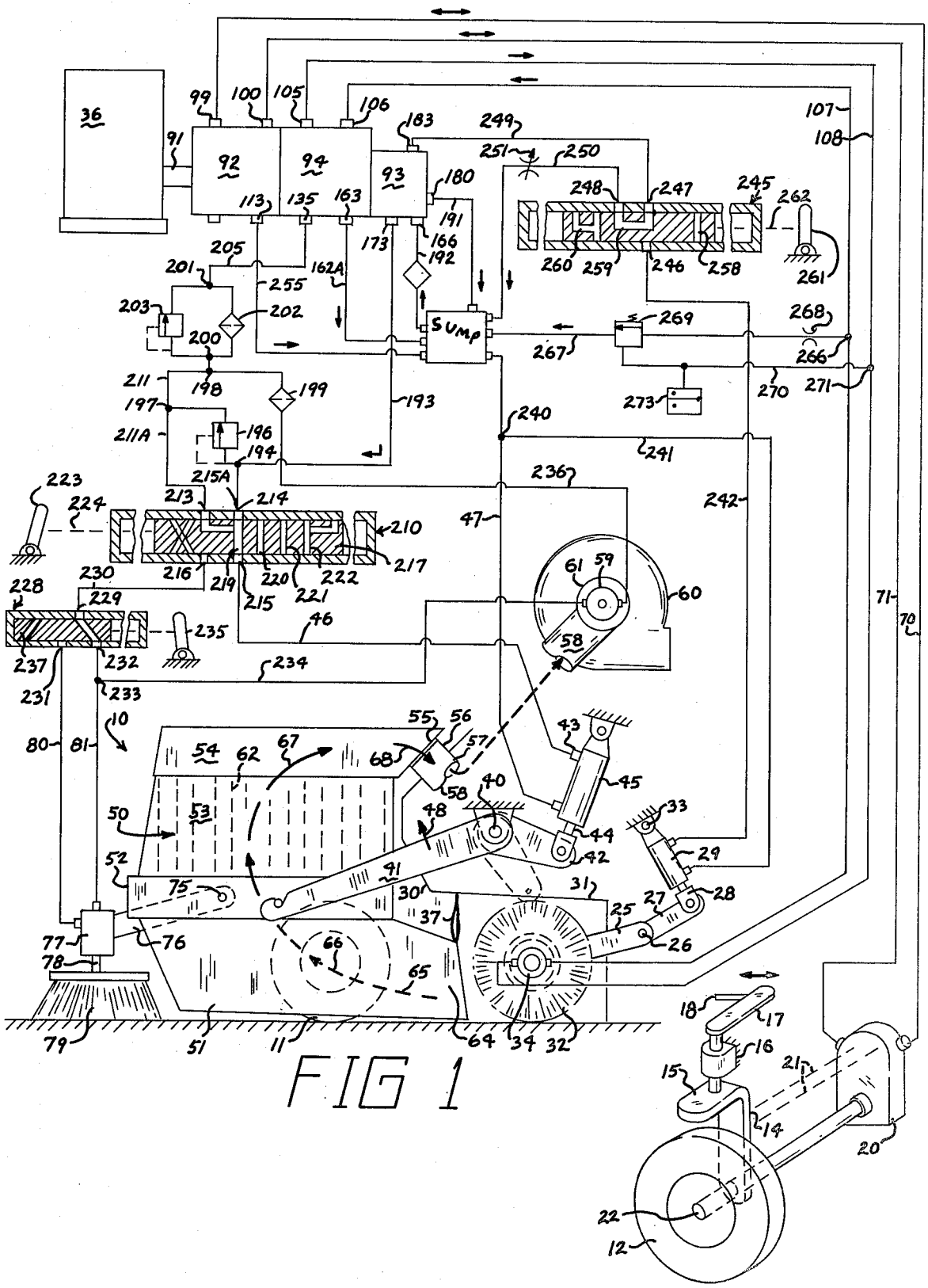
FIG. 1 is an illustrative schematic view showing one form of the sweeping machine embodying the invention.
Figure 2:
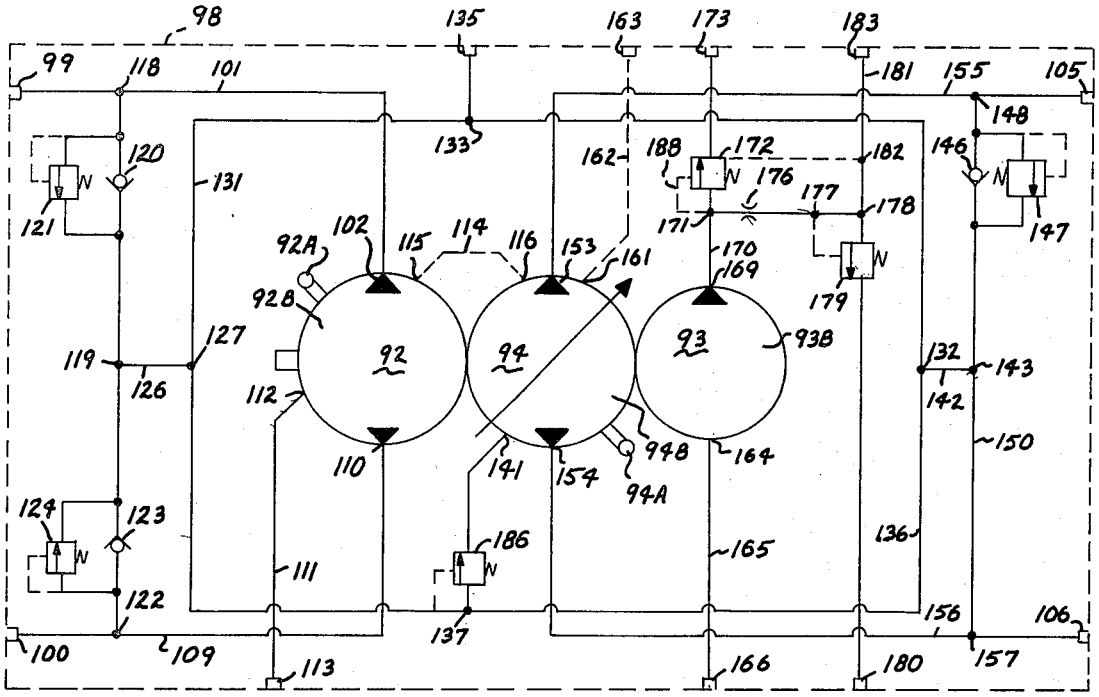
FIG. 2 is a schematic showing of the pump sections, including internal circuitry.
Figure 7:
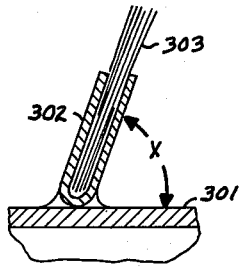
FIG. 7 is a fragmentary cross sectional view through one of the tuft mounting flanges, said view being generally taken along the line and in the direction of the arrows 7—7 of FIG. 6.

Referring now in particular to FIGS. 1 and 2, the invention may be embodied in varied forms of sweeping machines, the exact configuration of which may be varied. Illustrated forms of machines which may be used as a basic arrangement for embodying the invention, are illustrated in U.S. Pat. Nos. 3,540,070; 2,972,159; 3,186,021; 3,189,931 and 3,160,908, which show in greater detail the mechanical configuration of the particular sweeping machine illustrated in the present application. As the details of the mechanical configuration of the sweeping machine may be varied, it is to be understood that the particular machine herein described is merely illustrative and is not a limitation of the invention.

In FIG. 1, the machine, generally designated 10, includes a wheel frame 30 having front wheels 11 and a steering and propulsion wheel 12. The wheel 12 is supported on a suitable bracket 14, which is mounted by a vertical spindle 15 in the bearing 16, and the spindle is provided with a side arm 17 and drag link 18, the drag link being connected to a suitable steering apparatus so that the wheel 12 can be turned about the axis of the spindle 15 for steering motion. The bracket 14 which carries the wheel also serves to support a hydraulic motor, generally designated 20, which is attached by suitable bolts 21 to the outer surface of the bracket 14. The axle 22, once the wheel is mounted, is directly coupled to the shaft of the motor 20, or the wheel may be mounted on the motor shaft.

On the sweeping machine frame 30, there is provided a transverse open bottom housing or brush enclosure 31 which serves to contain the cylindrical main drive brush 32. The main drive brush 32 is mounted for rotation by radius arms 25 and is driven by a hydraulic motor 34. The ends of the radius arms opposite the brush are attached to a pivot shaft 26 to rotate therewith, shaft 26 being pivotally mounted on the sweeper frame. To selectively pivot the pivot shaft 26 there is provided a crank arm 27 which has the piston rod 28 pivotally connected thereto. The piston rod forms part of a piston cylinder combination 28, 29, the cylinder 29 being pivotally mounted at 33 to the sweeper frame.

The enclosure 31 has an opening across its front face, extending from side wall to side wall of the enclosure, and provided with a flexible gasket 37 all around.

The machine has a pivot shaft at 40 upon which a pair of forwardly extending support arms 41 are provided, the shaft also being provided with a crank 42 that is coupled to the piston rod 44 of the hydraulic cylinder 45, the base of which is suitably pivoted on the machine frame. Hydraulic supply and return lines 46 and 47 are fluidly connected to cylinder 45. When pressurized fluid is applied through cylinder port 43, the arms 41 are swung upwardly in the direction of arrow 48.

On the parallel arms 41 there is mounted a debris, dirt and dust receiving receptacle and filter unit, generally designated 50. This unit consists of a dust and debris receiving pan 51 which is connected at the bracket 52 to a housing 53 containing dust filter equipment. The upper part of the housing 53 is connected to a plenum chamber 54 which is in communication with the top clean side of the filter 62 within the housing. The plenum chamber has a suction outlet at 55 which seats upon a soft gasket 56 that surrounds a port 57 connected to the suction line 58. The port and suction line are on the frame of the machine proper. The suction line 58 connects with the inlet 61 of the suction blower 60 which is mounted on the machine frame. The suction blower is driven by a hydraulic motor 59.

The filter 62 and the housing serve to remove the dust from the air, and the dust residue falls into the pan 51.

The pan 51 has a rearwardly extending bottom portion 64 which fits into the opening in the front part of the sweeping housing 31 and is sealed thereto by the gasket 37. The brush 32 revolves clockwise as shown in FIG. 1, and sweeps dirt, debris and dust in the direction of the arrow 65 into the pan, where the heavier particles of the dirt and debris accumulate. The dust carried by the air which enters the mouth 64 of the pan from the sweeping housing, generally travels in the direction of the arrow 66 and after passing up through the filter 62, where the air is clean, the clean air continues its travel in the direction of the arrow 67 through the plenum chamber 54 and thence enters the port 57 and the tube 58, as shown by arrow 68, and continues through the tube to the inlet of the suction blower.

Pivoted at 75 on the machine frame is a forwardly extending arm 76 which serves as a mounting for the hydraulic motor 77, the output shaft 78 of which extends downwardly and carries an auxiliary brush such as curb brush 79. Hydraulic lines 80 and 81 serve as pressure and return lines respectively for the hydraulic motor.

The drive shaft of motor (power source) 36 is mechanically coupled to the shaft 91 of the three pumps 92, 94, 93 to drive the pumps. Pumps 92–94 include a variable displacement piston type pump section 92, a variable displacement piston type pump section 94, and a fixed displacement type pump 93. The pump section 92 through a closed circuit drives motor 20. That is, line 70 is connected to the port 99 of the housing of the pump section 92 and line 71 is connected to port 100. Pump section 92 includes a variable displacement pump member **92*b* that has a swash plate control 92*a* to regulate the amount of fluid under pressure being pumped to motor 20 and accordingly regulates the speed of movement of the vehicle; pump section 92 being of an over center type that provides for reverse flow to the motor 20 and thereby for the reverse rotation of the motor 20 as well as a neutral or stop position. The pump section 94 includes a variable displacement member 94*b* that has a swash plate control 94*a* to regulate the amount of fluid under pressure being pumped to the main brush motor 34 and accordingly the speed of rotation of the brush; motor 34 being connected by lines 107 and 108 to ports 106 and 105 respectively that open to the housing 98 of the pumps. Pump section 94** is of an over center type that provides for a neutral or a stop position.

Within the housing 98 there is provided internal circuitry that includes a line 101 connecting port 99 to a port 102 of pump member **92*b*, a line 109 connecting port 100 to port 110 of pump member 92*b*, a line 111 connecting pump member port 112 to port 113, on housing 98 and a line 114 connecting port 115 of pump member 92*b* to port 116 of pump member 94*b*. Provided in line 101 is a junction 118, a check valve 120 and a pressure relief valve 121 being connected in parallel across junctions 118 and 119. When the pressure at junction 119 is higher than it is at junction 118, the check valve 120 permits fluid flow therethrough from junction 119 to junction 118, but prevents flow in the reverse direction. The valve 121 is resiliently retained in a closed condition; however, when the pressure at junction 118 has exceeded that at junction 119 by a predetermined pressure, valve 121 will open to permit fluid flow therethrough from junction 118 to junction 119**.

Connected in parallel across junction 119 and a junction 122 on line 109 are a check valve 123 and a pressure relief valve 124. Check valve 123 permits fluid flow therethrough from junction 119 to junction 122 when the pressure at junction 122 is lower than that at junction 119, but prevents reverse flow therethrough. Further, valve 124 is normally retained in a closed condition; however, when the pressure at junction 122 exceed that at junction 119 by a predetermined value, valve 124 opens to permit fluid flow from line 109 to junction 119. A line 126 connects junction 119 to junction 127. Lines 131 and 136 are connected in parallel between junction 127 and junction 132, junction 132 being connected by a line 142 to junction 143. A junction 133 is provided on line 131 and connected by a line 134 to the port 135 on housing 98; while a junction 137 is provided on line 136. A pressure relief valve 186 is connected between junction 137 and a port 141 on pump member **94*b*; the valve being resiliently retained in a closed position; however, when the pressure in line 136 exceeds that at port 141 by a predetermined value, valve 186 opens to permit fluid to pass from junction 137 to port 141 for maintaining the charge circuit pressure within pump sections 92, 94**.

A line 156 connects the port 154 on pump member **94*b* to port 106 while a line 155 connects port 153 on pump member 94*b* to a port 105 in housing 98. A junction 148 is provided on line 155, a check valve 146 and a pressure relief valve 147 being connected in parallel across junction 148 and 143. The check valve 146 prevents fluid flow therethrough from junction 148 toward junction 143, but permits fluid flow therethrough from junction 143 to junction 148 when the fluid pressure at junction 143 is higher than that at junction 148. The relief valve 147 is resiliently retained in a closed position but upon the pressure at junction 148 being greater than that at junction 143 by a preselected amount, permits fluid flow through the valve toward junction 143. A junction 157 is provided in line 156 which is connected by a line 150 to junction 143**.

A port 161 on pump member **94*b* is connected by a line 162 to port 163. Inlet port 164 on pump member 93*b* is connected by a line 165 to port 166 while a pressure port 169 on pump member 93*b* is connected by a line 170 to junction 171. A valve 172 is connected across junction 171 and a port 173, while a flow restrictor 176 is connected across junctions 171 and 177. Junction 177 is connected by a line to junction 178, a pressure relief valve 179 being connected across junction 178 and a port 180. Valve 179 is resiliently retained in a closed condition; however, upon the pressure at junction 177 exceeding that at 178 by a preselected amount, opens to permit fluid flow therethrough from junction 178 to port 180. Junction 178 is connected by a line 181 to port 183, there being provided a junction 182 on line 181. The restrictor 176 meters the flow to port 183 to provide a nearly constant rate of flow therethrough, for example, 2 gallons per minute. The main volume of flow from pump section 93 is through port 173, valve 172 maintaining the pressure of the fluid passing through port 183 nearly constant. That is, valve 172 is spring urged to block from from junction 171 to port 173, a line 187 connecting junction 182 to the valve that provides a pressure acting to retain the valve in a fluid blocking position. A line 188 is connected between junction 171 and valve 172 to provide for opening valve 172 whereby the fluid flow in line 181 over that required at port 183 passes through the valve to port 173. Thus the excess flow, for example, 8 gallons per minute, passes through port 173**.

A fluid return line 191 is connected between port 180 and the sump 252 while a suction line 192 having a filter therein is connected between the sump and the inlet port 166 to provide charge fluid for pump section **93*b*. A line 193 is connected between outlet port 173 and junction 194, a bypass valve 196 being connected between junction 194 and 197. Valve 196 is normally retained in closed position, however, when the pressure at junction 194 exceeds a predetermined value, the valve is pressure opened to bypass fluid through the valve from junction 194 to junction 197. A line 211 is connected between junction 197 and junction 198 while a line connects junction 198 to junction 200. A filter 202 is connected between junctions 200, 201 while a by-pass valve 203 is connected between junction 200, 201 to permit fluid bypassing in filter 202 in the event the pressure at junction 200 exceeds a predetermined value. A line 205 connects junction 201 to the inlet port 135**.

A line **211*a* connects junction 197 to a port 213 of the four-position control valve, generally designated 210. Valve 210 includes a second port 214, a third port 215, and a fourth port 216, and a valve member 217. The valve member is provided with cross passages 218 that in a valve first position fluidly connects port 213 to port 215 and port 214 to port 216; passages 219 that in the valve second position fluidly connects ports 213, 214, 215 to one another, passages 220, 221 that in a valve third position fluidly connects port 213 to port 216, and port 214 to port 215; and passages 222 that in a valve fourth position fluidly connects ports 213, 215 and 216 to one another. A manually operated control 223 is connected by linkage 224 for moving the valve member 217** between its four positions.

Port 214 is connected by line **215*a* to junction 194, while line 46 is connected to port 215. Port 216 is connected by line 230 to a first port 229 of a two-position valve, generally designated 228. Valve 228 has a second port 231 to which line 80 is connected, and a third port 232 which is connected to junction 233. Junction 233 is connected to line 81 and is connected by line 234 to a port of the fluid motor 59 for applying fluid under pressure thereto. Valve 228 includes a valve member 237 having a passageway that in valve member first position fluidly connects port 229 to port 232, and in a valve second position has a passageway that fluidly connects port 229 to port 231. A manually operated control 235 is provided for moving valve member 237 between its positions. A line 236 connects the output port of fluid motor 59 to a cooler 199, which in turn is connected to junction 198**.

One port of the brush lift cylinder 29 is connected by line 241 to junction 240 which in turn is connected to line 47 and to the sump, while a second port of the cylinder is connected by line 242 to a first port 246 of a three position control valve, generally designated 245. Valve 245 includes a second port 247 that is connected by line 249 to outlet port 183, a third port 248 that is connected by line 250 to the sump and a valve member 257. A flow restrictor 251 is provided in line 250. Valve member 257 has a passageway 258 that in a valve member first position fluidly connects port 246 to port 247; a passageway 259 that in a valve member second position fluidly connects port 247 to port 248; and a fluid passageway 260 that in the valve member third position fluidly connects ports 246 and 247 and 248 to one another. A manually operated control 261 is connected by a linkage 262 to the valve member 257 for moving the valve member between its three positions.

When motor 36 is energized and the valve 210 is in its second position, no fluid under pressure is applied to either curb brush motor 77 nor the blower motor 59. However, fluid under pressure is applied through line 46 to the upper port of elevating cylinder for elevating the hopper. Further, port 214 is connected to port 213 so that fluid under pressure is being applied at port 135 to provide charge fluid in lines 131, 136 of the pump sections 92, 94. This provides fluid under pressure for recharging lines 70, 71, 108, 107 in the event the pressure therein is below a preselected value. That is, the check valves 120, 123 and 150 control the flow of fluid under pressure from lines 131, 136 to the respective one of lines 70, 71, and 108. In the event the pressure in lines 131, 136 is above the preselected value, which is the usual situation, valve 186 opens to return the fluid through port 141 to flow through the internal circuitry of pump sections 92, 94 including line 114 to flow through port 113 to line 255 and therethrough to the sump. Lines **162*a* and 255 are drain lines for the pump casing, line 162*a* being connected between port 163** and the sump.

When valve 210 is operated to its first position, fluid under pressure from port 214 is applied to port 229 of control valve 228. At this time fluid under pressure in line 246 is exhausted and as a result the hopper is moved to its lowered street level sweeping position. If the valve 228 is in its first position fluid under pressure at port 229 is provided through junction 233 for operating the blower motor; but the curb motor 77 is not operated since port 231 is blocked. If the valve 228 is in the second position, then fluid under pressure from port 229 is applied at port 231 and flows through the curb brush motor 77 and the blower motor 59 for operating the curb brush and blower motor.

When valve 210 is in its third position, fluid under pressure is applied from port 214 to port 215 for operating cylinder 45 for elevating the hopper 50 while port 216 is connected to port 213. As a result neither the curb brush motor nor the blower motor are operating.

When control valve 210 is now operated to its fourth position, no fluid under pressure is applied to port 215; however, fluid under pressure is applied to port 216, and thus to port 229. As a result, either the blower motor or both the blower motor and curb brush motor are operating, depending upon position of valve 228.

When valve 245 is in its second position, no fluid under pressure is applied to the brush lift cylinder 29; while when the valve 245 is connected in its first position, port 247 is connected to port 246 whereby cylinder 29 operates the brush to an elevated travel position. When valve member 245 is in its third position part of the fluid at 247 flows directly to port 248. However due to the flow restrictor 251, fluid under pressure at port 246 provides a lifting pressure to cylinder 29 to provide a decrease in brush pressure on the surface being cleaned, but not sufficiently great to lift the brush off the surface being cleaned.

By moving control 92A in the appropriate direction, fluid under pressure is applied to motor 20 for propelling the vehicle, the speed and direction (forward or reverse) of the movement of the vehicle being dependent upon the position of the control 92A. The further the control 92A is moved from its neutral position, the greater the volume of fluid applied to motor 20 for propelling the vehicle, and accordingly, the higher the speed that is obtained.

By moving control 94A in the appropriate direction, fluid under pressure is applied to motor 34 for drivingly rotating brush 32, the speed of movement of the brush being dependent upon the position of the control 94A. The further the control 94A is moved from its neutral position, the greater the volume of fluid applied to motor 34 and accordingly the greater the number of revolutions of the brush per minute, i.e. a variable speed brush.

A junction 266 is provided in line 108, this junction being connected by a line 267 to the sump 252. A flow restrictor 268 is provided in the line 267, whereby a small constant flow of oil from the main brush drive circuit is constantly recirculated back to the sump. That is the flow restrictor is set to give a small flow of oil, for example, two to four gallons per minute. This results in the constant recirculation of oil in the brush motor drive circuit to provide for cooling of oil in said circuit.

Provided in line 267 between the flow restrictor 268 and the sump is a pilot operated relief valve 269, there being a line 270 connected between valve 269 and a junction 271 in line 108. The relief valve 269 functions to close the bleedoff when the pressure in the line 108 at the inlet of the main brush motor 34 drops below a preselected value, for example 100 p.s.i. or less. Thus the relief valve prevents main brush motor cavitation in the event of engine shutdown while the main brush is still rotating.

A pressure sensing switch 273 is connected to line 270. This switch closes to energize a red warning light (not shown) on the instrument panel at a preselected pressure, at the main brush motor inlet, for example 2200 p.s.i., to warn the operator of an excessive brush load and impending motor stall.

Figure 3:
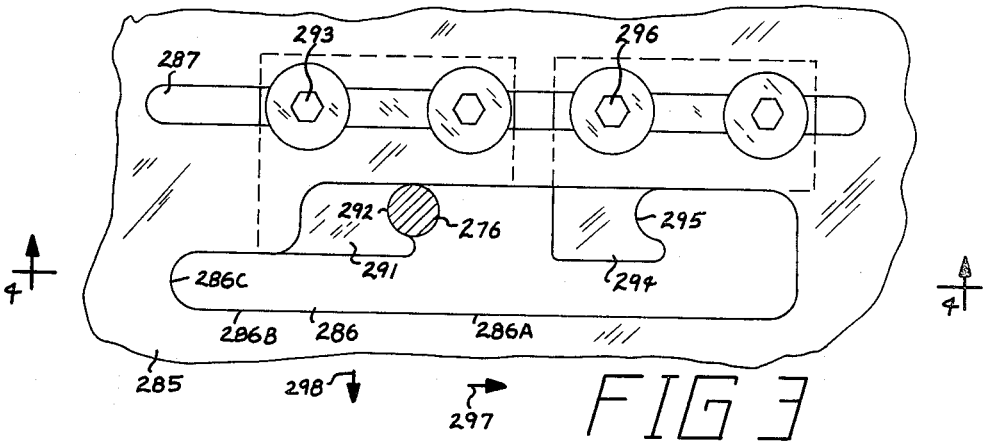
FIG. 3 is a fragmentary top view of part of the control apparatus that may be used for the main brush variable displacement pump.
Figure 4:
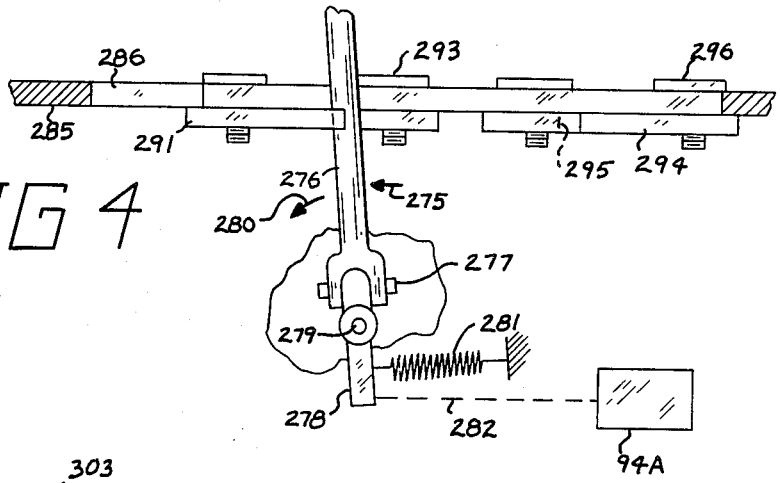
FIG. 4 is a cross-sectional view generally taken along the line and in the direction of the arrows 4—4 of FIG. 3.

Referring now to FIGS. 3 and 4, there is shown control mechanism, generally designated 275, that may be utilized to control the position of the control 94A for the pump section 94 in the event that it is desired to provide for a predetermined low brush speed and a predetermined high brush speed. The control mechanism includes a control lever 276 that at its lower end is pivotally connected by member 277 to an operator 278. An intermediate part of the operator is pivotally connected by a pivot member 279 to the frame, the pivot axis of the pivot member 279 being at right angles to the pivot axis of the pivot member 277. A spring member 281 is connected to the lower portion of the operator and to the frame for resiliently urging the operator to pivot in the direction of arrow 280, while a linkage 282 also is connected to the lower end of the operator for moving the control member 94A.

The control lever 276 extends upwardly through an elongated slot 286 that is provided in the plate 285, the plate 285 being mounted on the frame. The slot 286 has an elongated portion that is of a substantially greater transverse width than the end portion **286*b*. The spring 281 acting through the operator resiliently urges the lever 276 to pivot in the direction for abutting against the end 286*c* of the slot portion 286*b* that is on opposite slot portion 286*a***.

The plate 285 is also provided with an elongated slot 287, screws 293 being extended through the slot to mount a stop 291 in an adjusted position along the length of the slot. Stop 291 extends in underlying relationship to plate 285 to have a semi-circular recess portion 292 located beneath the slotted portion **286*a*. Recess 292 is provided for retaining the lever 276 in a preselected position against the action of spring 281 urging the operator to pivot in the direction of arrow 280. The stop 291 is positioned on the plate for retaining the lever 276 in a position that control element 94*a*** results in the main brush being driven at a preselected low speed, for example, 200 rpm.

A second stop 294 is likewise mounted on plate 285, screws 296 being extended through the slot 287 for retaining the stop 294 at a preselected adjusted position. The stop 294 includes a semi-circular recess 295 for retaining the lever 276 in a second preselected position against the resilient urging of spring 281 that control element **94*a* is positioned such that the main brush is operated at a preselected high speed, for example 1000 rpm. Thus, the lever 276 may be retained in one of three select positions and may be moved from the position shown in FIG. 3 by moving the lever in the direction of arrow 297 to pivot the operator in the direction opposite of arrow 280 about pivot 279 until the lever clears recess 292, then move the lever in the direction of arrow 298 so that the lever pivots about pivot 277, thence move the lever in the direction of arrow 297 to be forward of the notch 295, and then in the direction opposite of the arrow 298 and allow the lever to move in the direction opposite arrow 297 to abut against the edge defining recess 295. When the lever abuts against edge 286*c*, pump section 94 is in a stop condition and accordingly the main brush is not being driven. When cleaning a surface having debris thereon that is hard to remove, for example, compacted direct, oil or ect., the lever is positioned in recess 295 so that the brush is rotated at a high brush speed and the sweeper is driven forwardly at a low rate of sweeper forward travel. For normal sweeping the lever is positioned in recess 292**.

Figure 6:
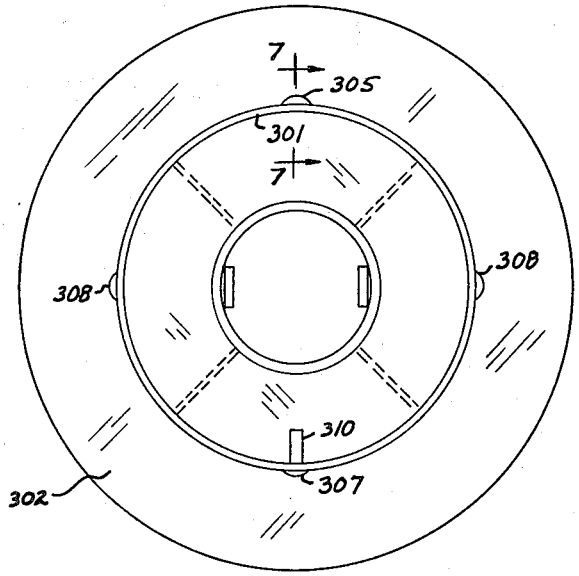
FIG. 6 is an end view generally taken along the line and in the direction of the arrows 6—6 of FIG. 5.
Figure 5:
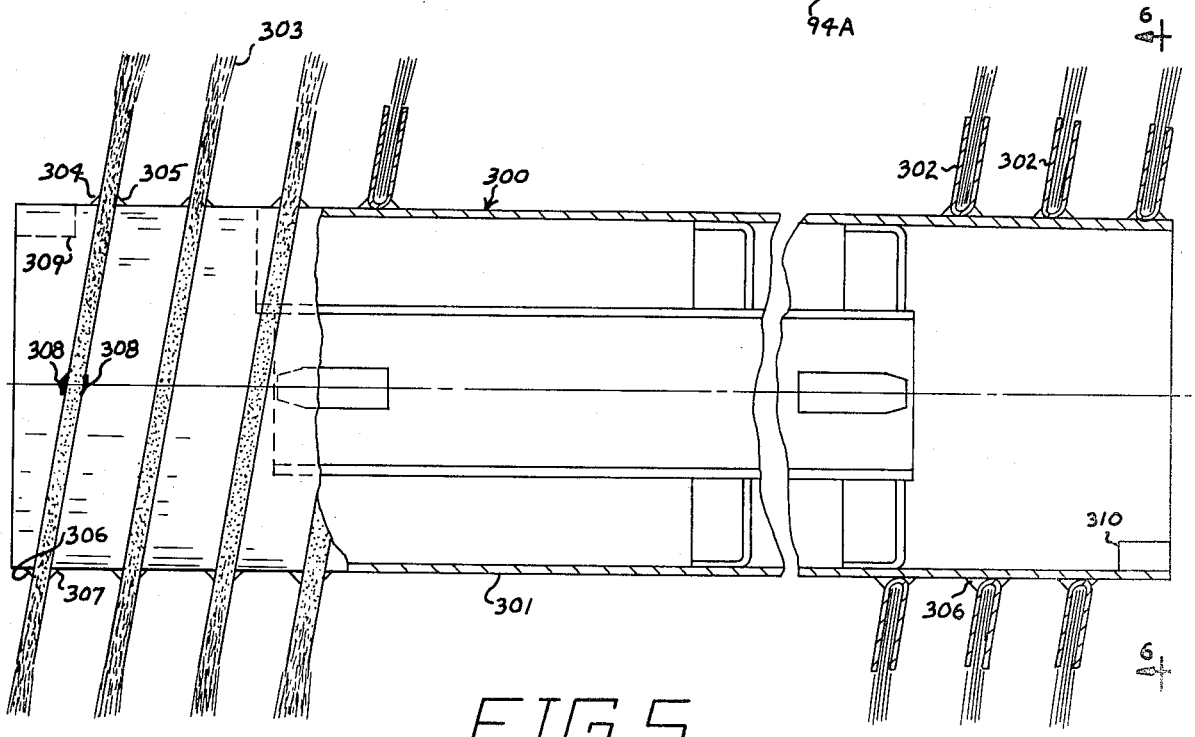
FIG. 5 is a view of a brush assembly, said view in part being shown in cross section.

Referring now to FIGS. 5 and 6, there is shown a brush, generally designated 300, that has a plurality of annular metal tuft mounting flanges 302 provided on a metal tubular core 301 to have the planes thereof inclined at an angle X to the central axis of rotation to the core. Each side of the flange is respectively mounted to the core by tack welds 304, and 305, 306 and 307 respectively. Tack welds 304 and 305 are on axial opposite sides of the flanges as are welds 306, 307. Welds 304, 305 are on diametrically opposite sides of the core and axially offset from welds 306, 307 as shown in FIG. 5. Further, on each side of the flanges, there are provided tack welds 308 that are angularly offset (90°) from welds 304, 305. Due to tack welding, the flanges may be removed from the core and replaced when the flanges are damaged or the tufts 303 thereof are worn, it being noted that the core is relatively expensive. In order to overcome the unbalancing of the brush resulting from the inclination of the flanges, weights 309 and 310 are secured to the interior of the core at axial opposite ends thereof and diametrically opposed from one another.

As an example of one embodiment of the brush of the invention, the angle x of the planes of the brush mounting flanges 302 relative the core central axis L—L may be about 10°, and for a brush core having an outside diameter of 9 inches, the arcuate length of each tack weld may be about ¾ inch.

What is claimed is:

1. A surface maintenance machine having a frame, propulsion and steering wheels on the frame, a main surface cleaning brush, means for mounting the main brush on the frame, hydraulic motor first means for driving the propulsion wheel, hydraulic motor second means for driving the brush, a reversible variable displacement first pump, a variable displacement second pump, power source means for driving the pumps, first and second lines for conducting hydraulic fluid under pressure from the first pump to the first motor means and return fluid from the first motor means to the first pump, and third and fourth lines for conducting hydraulic fluid under pressure from the second pump to the second motor means and return fluid from the second motor means to the second pump.

2. The apparatus of claim 1 further characterized in that there is provided control means for the second pump means to selectively vary the amount of fluid under pressure pumped by the second pump means to the second motor means.

3. The apparatus of claim 1 further characterized in that it includes a curb brush mounted on the frame, a hopper for receiving debris, means for mounting the hopper on the frame, operable suction blower means fluidly connected to the hopper to withdraw air therefrom, a third hydraulic pump, a third hydraulic motor for driving the curb brush, a fourth hydraulic motor for operating the blower means, and means for fluidly connecting the third pump to the third and fourth motors to selectively drive the third and fourth motors.

4. The apparatus of claim 3 further characterized in that the means for mounting the hopper includes operatable lift arm means mounted on the frame for mounting the hopper and moving the hopper between a street level sweeping position and an elevated dumping position and piston cylinder means for operating the lift arm means for moving the hopper between its positions, and that the means for fluidly connecting the third pump to the third and fourth motors includes means for selectively applying fluid under pressure from the third pump to piston cylinder means.

5. The apparatus of claim 3 further characterized in that there is provided a sump, a fluid line having a flow restrictor therein for conducting a limited amount of fluid from one of third and fourth lines to the sump and that the means that is fluidly connected the third and fourth motors is connected to the second pump for supplying the charging fluid thereto and a suction line between the sump and third pump.

6. The apparatus of claim 5 further characterized in that the main brush includes an axially elongated tubular metal brush core having a central axis, several annular tuft mounting metal flanges, and a plurality of angularly spaced tack welds for each flange to secured the respective flange to the brush core in axial spaced relationship to the other flanges on the brush core.

7. The apparatus of claim 6 further characterized in that the flanges have axial opposite sides and that there are four tack welds securing each flange side to the brush core.

8. A surface maintenance machine having a frame, ground engaging wheels mounted on the frame, a rotary main surface cleaning tool, means for mounting the tool on the frame, hydraulic motor means for drivingly rotating the tool, a variable displacement pump, first and second lines for conducting hydraulic fluid from the pump to the motor means and return fluid from the motor means to the pump, and control means for the pump to selectively vary the amount of fluid under pressure pumped by the pump to the motor means, the control means including a control lever, means movably mounting the lever on the frame, linkage means for operatively connecting the lever to the pump, and means for movably retaining the control lever in any one of three selected positions, including a stop position, the last mentioned means including a plate mounted in the frame that has an elongated slot, the lever being extended through the slot, said plate having an edge portion defining one end of said slot, and first and second stop means mounted on the plate for selected adjustment on the plate relative the length of the slot and extended partially across the slot for retaining the lever in preselected positions.

9. The apparatus of claim 8 further characterized in that the plate has a second elongated slot adjacent the first slot that is elongated in the same direction as the first slot and that the stop means includes a first stop, a second stop, each of said stops having a lever receiving recess, and means for each of the stops extended through the second slot to retain the stops in adjusted spaced relationship with their recesses facing remote from said edge portion and extending partially across the first slot.

10. A surface maintenance machine having a frame, propulsion and steering wheels on the frame, a main surface cleaning brush, means for mounting the main brush on the frame, hydraulic motor first means for driving the propulsion wheel, hydraulic motor second means for driving the brush, a reversible variable displacement first pump, a variable displacement second pump, power source means for driving the pumps, first and second lines for conducting hydraulic fluid under pressure from the first pump to the first motor means and return fluid from the first motor means to the first pump, and third and fourth lines for conducting hydraulic fluid under pressure from the second pump to the second motor means and return fluid from the second motor means to the second pump, and control means for the second pump means to selectively vary the amount of fluid under pressure pumped by the second pump means to the second motor means, the control means including a control lever movably mounted on the frame, linkage means for operatively connecting the lever to the second pump means, and means on the frame for movably retaining the control lever in any one of at least three selected positions.

11. A surface maintenance machine having a frame, propulsion and steering wheels on the frame, a main surface cleaning brush means for mounting the main brush on the frame, hydraulic motor first means for driving the propulsion wheel, hydraulic motor second means for driving the brush, a reversible variable displacement first pump, a variable displacement second pump, power source means for driving the pumps, first and second lines for conducting hydraulic fluid under pressure from the first pump to the first motor means and return fluid from the first motor means to the first pump, and third and fourth lines for conducting hydraulic fluid under pressure from the second pump to the second motor means and return fluid from the second motor means to the second pump, a curb brush mounted on the frame, a hopper for receiving debris, means for mounting the hopper on the frame, operable suction blower means fluidly connected to the hopper to withdraw air therefrom, a third hydraulic pump, a third hydraulic motor for driving the curb brush, a fourth hydraulic motor for operating the blower means, and means for fluidly connecting the third pump to the third and fourth motors to selectively drive the third and fourth motors, the means for mounting the main brush including piston cylinder means for moving the main brush between a surface sweeping position and an elevated travel position, a sump, and means connected between the third pump, sump and the last mentioned piston cylinder means for selectively applying fluid under pressure from the third pump to the last mentioned piston cylinder means to move the main brush between its position.

* * * * *